US006997315B2

(12) United States Patent
Myer et al.

(10) Patent No.: US 6,997,315 B2
(45) Date of Patent: Feb. 14, 2006

(54) LOW PROFILES STORAGE APPARATUS AND METHOD

(75) Inventors: Charlene Myer, Blooming Prairie, MN (US); Jose Barrios, New Richland, MN (US); Jim Wanberg, Owatonna, MN (US)

(73) Assignee: SPX Corporation, Charlotte, NC (US)

( * ) Notice: Subject to any disclaimer, the term of this patent is extended or adjusted under 35 U.S.C. 154(b) by 272 days.

(21) Appl. No.: 10/603,768

(22) Filed: Jun. 26, 2003

(65) Prior Publication Data

US 2004/0262182 A1 Dec. 30, 2004

(51) Int. Cl.
*B65D 85/00* (2006.01)

(52) U.S. Cl. ..... 206/372; 206/373

(58) Field of Classification Search ..... 206/349, 206/372, 373, 377, 378, 379, 223, 570, 571; 211/60.1, 69

See application file for complete search history.

(56) References Cited

U.S. PATENT DOCUMENTS 4,225,052 A * 9/1980 Tector et al.
5,004,103 A * 4/1991 Connors et al. ..... 206/372
5,553,712 A * 9/1996 Tisbo et al. ..... 206/752
D385,111 S * 10/1997 Dickinson et al. ..... D3/309
5,678,684 A * 10/1997 Wright ..... 206/204
5,758,769 A * 6/1998 Vasudeva ..... 206/349
5,788,072 A * 8/1998 Chen ..... 206/372
5,826,718 A * 10/1998 Ahern, Jr. et al. ..... 206/372
5,826,719 A * 10/1998 Chen ..... 206/373
6,044,973 A * 4/2000 Vasudeva ..... 206/372
6,260,700 B1 * 7/2001 Huang ..... 206/373
6,523,687 B1 * 2/2003 Ling ..... 206/378

* cited by examiner

*Primary Examiner*—Shian T Luong
(74) *Attorney, Agent, or Firm*—Baker & Hostetler LLP

(57) ABSTRACT

A method and apparatus used for storing items is provided. The apparatus includes a base, a tray configured to sit within the base and be removable from the base. The apparatus also includes a lid configured to be pivotably attached to the base and removable from the base. The lid is configured to enclose the tray between the base and the lid and the tray and the base configured to be no greater than about 2 inches in thickness. The method includes containing parts in a tray having cavities configured to store the parts. The method further includes containing the tray in the base, containing additional parts in the base, and removing a lid to uncover the tray. The method further includes placing the tray in toolbox drawer configured to accept an item of a thickness of about 2 inches or less.

20 Claims, 4 Drawing Sheets

LOW PROFILES STORAGE APPARATUS AND METHOD

FIELD OF THE INVENTION

The present invention relates generally to a storage box for storing tools. More particularly the invention relates to a take-apart low profile storage box for containing tools.

BACKGROUND OF THE INVENTION

Personnel such as mechanics, when servicing an automobile, often require a particular set of tools for servicing one or more aspects of an automobile. For example, when mechanics service a fuel injector of an automobile engine, there are certain tools and gauges that the mechanic will use to service the fuel injector. Some of the tools and gauges used in servicing a fuel injector may be specific to servicing fuel injectors, and may not be used for servicing other parts of an automobile. As a result of some tools being used only in specific applications, mechanics may find it desirable to group tools used for a specific task together. Keeping the tools together has the advantage in that the mechanic does not have to hunt through an entire collection of tools in order to locate the ones needed for servicing a particular aspect of an automobile.

Realizing the advantage of grouping related tools, tool manufacturing companies will sometimes package tools and gauges used for servicing a particular aspect of an automobile together and sell them as a kit for servicing that aspect. For example, tools, gauges and fittings used for servicing a fuel injector may be sold together as a kit in order to keep the tools, gauges and fittings all together. The related items may be packaged in a box or container that can also be used for storage on a long term basis rather than merely being the initial packaging for selling the related tools.

Often a mechanic may keep all the tools and other things the mechanic uses for servicing automobiles in a large toolbox. Mechanic's toolboxes are often made of steel and mounted on wheels or casters. Large toolboxes typically have the advantage of keeping all the tools together in one place. Another advantage of large toolboxes is that they may be lockable, which aids the mechanic in not having the tools misplaced or stolen. The large toolboxes often have multiple drawers for storing different tools. Many of the drawers are shallow in order to conserve space and provide ample drawers for storing many tools. One problem associated with self contained kits such as fuel injection servicing kits is that the storage case that comes with the kit can be too large to fit within the shallow drawers of the large mechanic's toolbox.

Accordingly, there is a need in the art for a method and apparatus that permits a kit or group of tools and related items for servicing a certain aspect of a vehicle to be contained and stored in a small storage case that is sized to fit within the shallow drawers of a mechanic's toolbox. It would be desirable for such an apparatus and method to provide the benefits of a self contained storage unit that keeps the tools, fittings and gauges necessary for servicing a particular aspect of a vehicle in one place. It would also be desirable for such an apparatus and method to fit within the large mechanic's toolbox which can provide security for the tools and also provide a common storage location with all of the other tools.

SUMMARY OF THE INVENTION

The foregoing needs are met, to a great extent, by the present invention, wherein in one aspect an apparatus is provided that in some embodiments provides the benefits of a self contained storage unit that keeps related items, such as for example, tools, fittings and gauges necessary for servicing a particular aspect of a vehicle in one place. Such an apparatus and method as some embodiments provides a unit that will fit within a large mechanic's toolbox to provide security for the tools and also provide a common storage location with other tools and servicing items.

In accordance with one embodiment of the present invention, a storage unit is provided. The storage unit includes a base, and a tray fitted to sit within the base and be removable from the base. The tray has a plurality of cavities to provide storage areas for parts, and the tray and base are configured to be no greater than about 2 inches in height and to define a storage area between the tray and the base when the tray is seated in the base. The storage unit also includes a lid configured to be pivotably attached to the base and removable from the base, the lid configured to enclose the tray between the base and the lid when the lid in a closed position.

In accordance with another aspect of the present invention, a storage unit is provided. The storage unit includes a base, and a means for containing items configured to sit within the base and be removable from the base. The containing means and base are configured to be no greater than about 2 inches in height and to define a storage area between the containing means and the base when the containing means is seated in the base. The storage unit also includes a means for covering the containing means configured to be pivotably attached to the base and removable from the base, the covering means configured to enclose the containing means between the base and the lid when the lid in a closed position.

In accordance with yet another aspect of the present invention, a method of storing items is provided. The method includes containing the items in a tray having cavities configured to store particular items. The method also includes containing the tray in a base, containing additional items in the base. Further aspects include removing a lid to uncover the tray and placing the tray in a toolbox drawer configured to accept an item of a thickness of about 2 inches or less.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
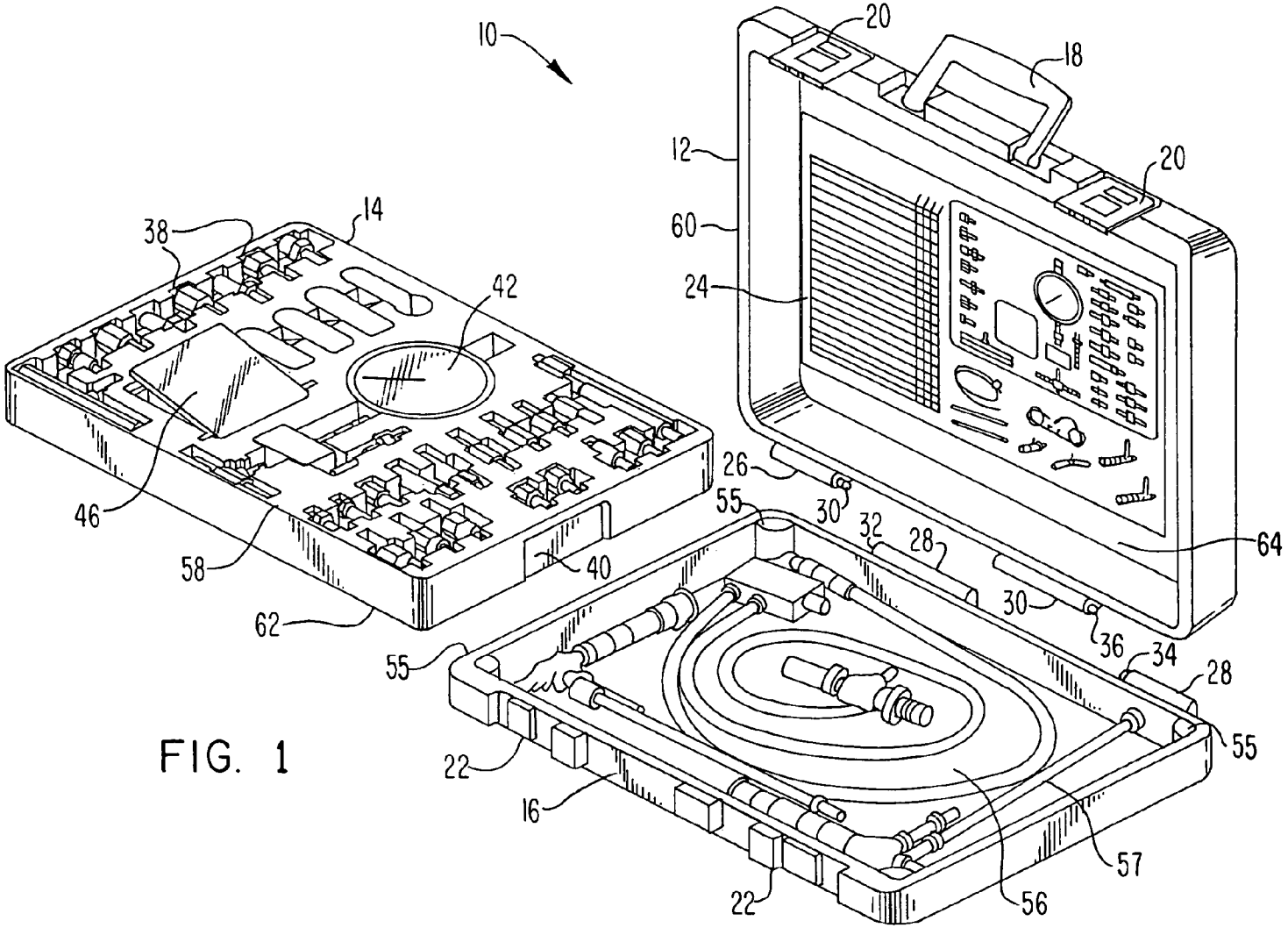
FIG. 1 is an exploded perspective view of one embodiment of the present invention showing a lid, tray and base disassembled and removed from each other.

The invention will now be described with reference to the drawing figures, in which like reference numerals refer to like parts throughout. An embodiment in accordance with the present invention provides a storage unit for storing related items such as, for example, tools, fittings and gauges used for servicing an aspect of a vehicle. A preferred embodiment of the invention includes a storage unit for containing tools, fittings and gauges used for servicing fuel injection systems. The storage unit includes a base, a removable tray and a lid. The tools, parts, gauges and fittings are stored in the tray and in the base. The tray and base have a relatively low profile and are thus able to fit in the shallow drawer of a mechanic's toolbox. Another aspect of the present invention includes a method of storing parts. The method includes containing the parts in a tray and base configured to receive those parts and placing the tray and/or base in a relatively shallow toolbox drawer.

Turning now to the figures, an embodiment of the present inventive apparatus is illustrated in FIG. 1. The storage unit 10 includes a lid 12, a removable tray 14 and a base 16. The lid 12 includes a handle 18 for facilitating carrying of the case 10. Latches 20 are located on the lid 12 at either end of the handle 18. The latches 20 communicate with corresponding structure 22 on the base 16 to latch the lid 12 to the base 16. The tray 14 is contained by the lid 12 and the base 16 when the lid 12 is latched to the base 16.

On the inside of the lid 12, a chart 24 is provided listing the tools, gauges, fittings and parts contained within the storage unit 10. The lid 12 attaches to the base 16 by hinges 26 and 28. The hinge 26 located on the lid 12 includes a lid hinge pin 30 that fits into a hole 32 contained within the base hinge 28. A second hinge pin 34 is located on the base hinge 28 which fits into a corresponding hole 26 located on the lid hinge 26. When the hinge pins 30 and 34 are fitted within the corresponding holes 32 and 36 the lid 12 and base 16 are pivotably attached. Hinge pins 30 and 34 are appendages protruding from hinges 26 and 28. In other embodiments of the invention, hinge pins 30 and 34 may be in the form of pins.

The lid 12 moves between an open and closed position. The lid 12 can be removed from the base 16 by removing the lid hinge pin 30 from its corresponding hole 32 and removing the base hinge pin 34 from its corresponding hole 36. Once the hinge pins 30 and 34 have been removed from the corresponding holes 32 and 36, the lid 12 can be removed from the base 16.

The tray 14 includes a plurality of storage cavities or holes 38 which are configured to store particularly sized parts, tools, fittings or gauges. In a preferred embodiment of the present invention, the storage cavities are sized so that the parts easily fit in the storage cavities 38. Sizing the cavities 38 to loosely contain the parts permits the parts to be easily removable from the tray 14. The lid 12 is configured so that when the lid 12 is closed, the lid 12 will hold the parts in the storage cavities 38.

Optionally, the storage cavities 38 can be configured to store the parts, tools, fittings or gauges, in a snap fit configuration. In a snap fit configuration the part can be snapped into the hole 38. A snap fit configuration can include slightly undersizing an entrance portion of the hole 38 so that the part must be pressed through the undersized portion. Once it passes through the undersized portion, the hole 38 is slightly oversized so that the part fits easily in the oversized portion. Alternatively, the holes 38 may be slightly undersized, not just at the entrance of the hole, but everywhere so the parts are press fit into the hole 38 and held in a secure but removable fashion.

In some embodiments of the present invention, the tray 14 includes a handle portion 40. As illustrated in FIG. 1, the handle 40, of tray 14, is a cut out portion which defines a ridge for which a user of the tray 14 can lift the tray 14 out of the base portion 16 by gripping the ridge established by the handle portion of 40. Optionally, a second handle portion may be included on the tray 14 on the opposite side of the first handle portion 40. Other embodiments of the present invention may include other type of handles or gripping structure configured to facilitate removal of the tray 14.

Figure 2:
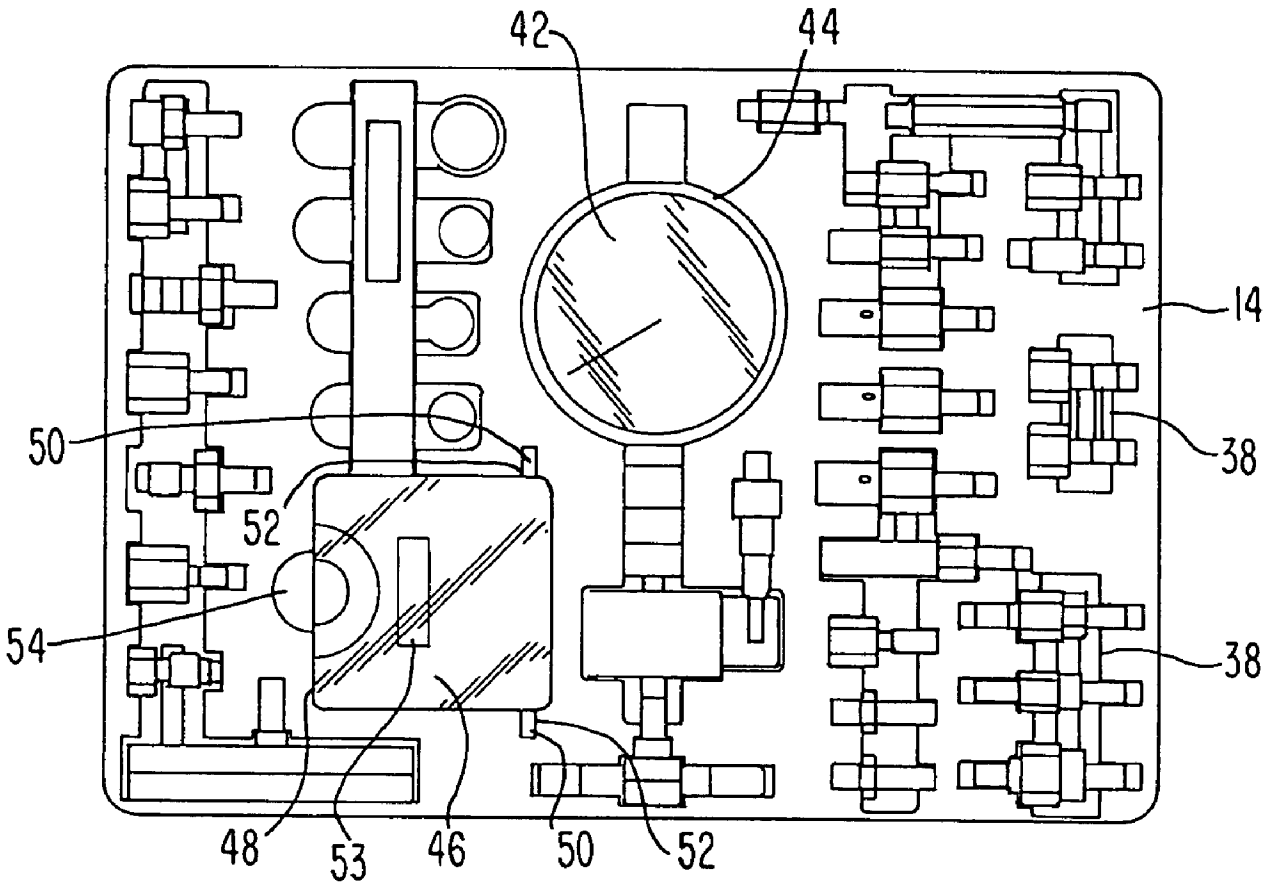
FIG. 2 is a top view of the tray shown in FIG. 1.

FIG. 2 is a top view of one embodiment of the tray 14. The tray 14 includes a plurality of storage cavities 38. In order to avoid overcrowding the drawing, only some of the storage cavities are noted by a reference numeral.

In some embodiments the present invention, a gauge is desired to be stored in a tray 14. In order to reduce the thickness of the tray 14, a hole 42 extends all the way through the tray 14 permitting a portion of the gauge to extend through the hole 42. Allowing the gauge to extend through the hole 42, can allow the tray 14 to have a smaller thickness that is possible if the tray 14 has a continuous floor. A lip 44 is provided in the hole 42 of the tray 14 so the gauge may be stored and held in place when the tray 14 is in an upright position (lying flat horizontally).

Some embodiments of the present invention, as shown in FIG. 2, include a door 46 for enclosing a storage area 48. A plurality of small odd sized parts may be desired to be stored together in a larger common storage area 48. In order to contain the miscellaneous parts, a door 46 is provided to enclose the parts in a storage area 48. In the embodiment shown in FIG. 2, the door 46 attaches to the tray 14 by hinge pins 50 that fit within holes 52 provided in tray 14. The hinge pins 50 allow the door 46 to pivot between an open and closed position.

The storage area 48 also contains a small storage box 53. The storage box 53 contains seals. In other embodiments of the invention, the storage box 53 could contain other parts or be absent altogether.

In some embodiments the invention, the door 46 is snap closed to the closed position by slightly under sizing the hole 48 for the door 46 at the entrance portion of the hole 48. Alternatively, the hole 48 and the door 46 may be press fit when in the closed position permitting the door 46 to be secured in the closed position. Other embodiments of the invention may have latches or other elements configured to hold door 46 shut.

The door 46 is preferably made of a relatively transparent material such as plastic. Making the door 46 transparent allows the door to be "see through" so that the parts contained in the hole 48 may be viewed. The tray 14 defines an indention 54, which allows a user's finger to wedge under the door 46 and facilitate opening the door 46. Alternatively, the door 46 may be equipped with a handle or other device to facilitate opening the door 46.

Figure 3:
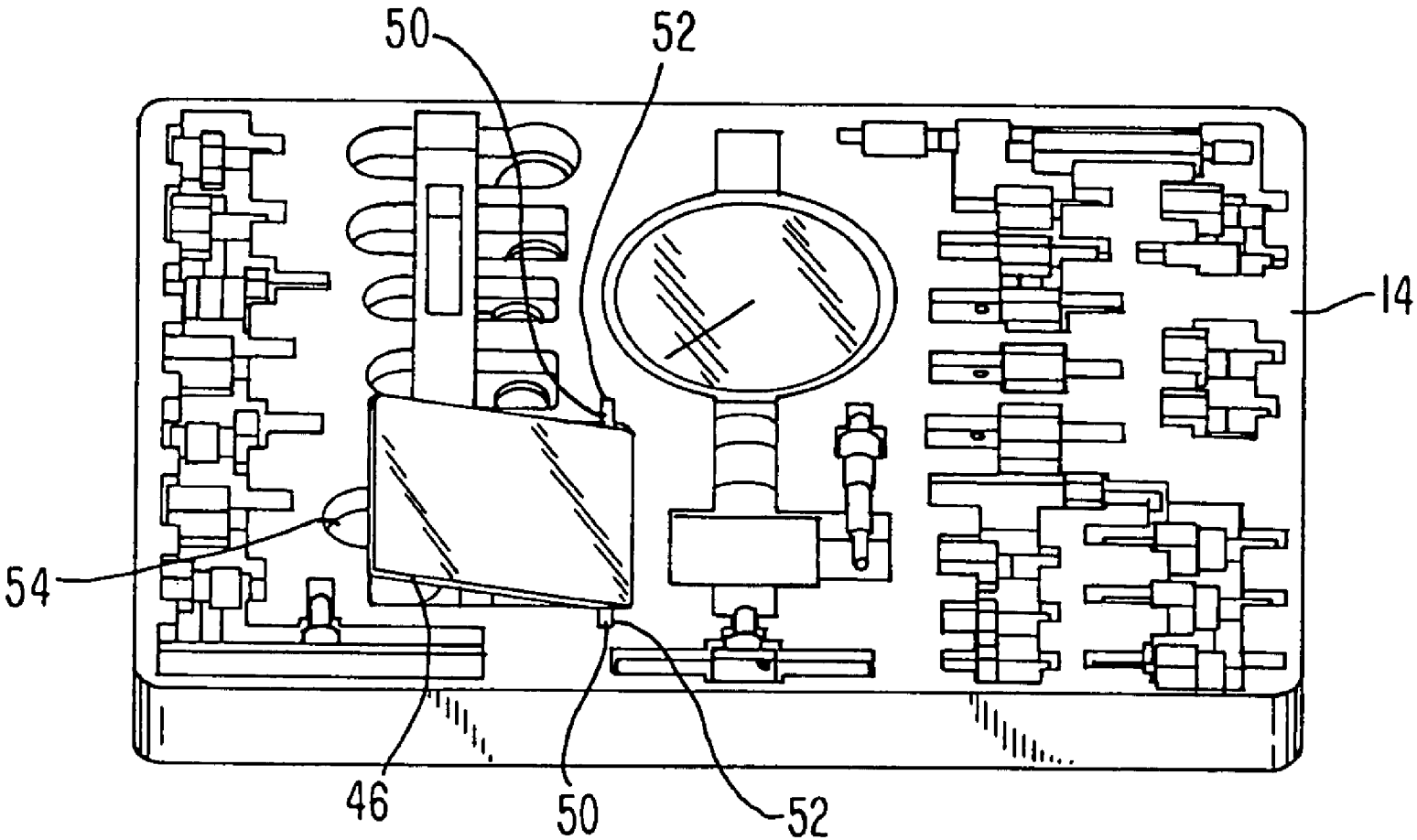
FIG. 3 is a perspective view of the tray of FIG. 1.

FIG. 3 is a perspective view of the tray 14 illustrating the door 46 in a slightly open position. The door 46 swings on the hinge pins 50 contained within the hinge pin holes 52 provided in the tray 14.

Returning to FIG. 1, the base 16 includes a seating structure 55 for permitting the tray 14 to be seated within the base 16. The seating structure 55 allows the tray 14 to be seated slightly above the floor 56 of the tray 16. Seating the tray 14 above the floor 56 permits a storage volume 57 to be defined between the floor 56 of the base 16 and the tray 14. Some tools, parts, fittings or gauges may be stored in this volume 57. The base 16 also includes latching structure 22 for permitting the latching buckles 20 on the lid 12 to latch to the base 16.

Figure 4:
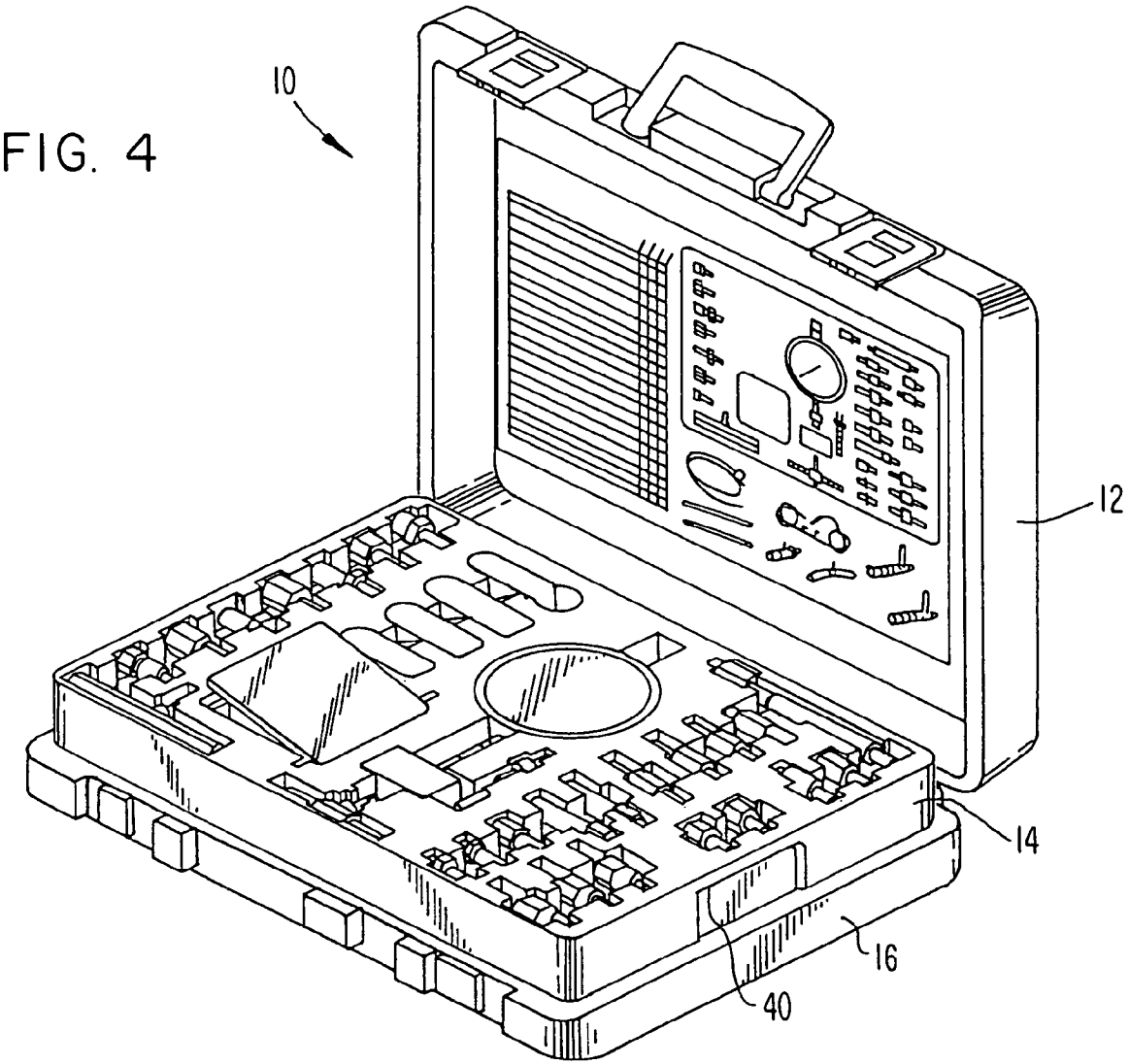
FIG. 4 is a perspective view of the present invention showing the tray seated in the base and the lid in an open position and mounted to the base.

FIG. 4 is a perspective view of the storage case 10 when the case 10 is assembled. The tray 14 sits on the supporting structure 52 (best shown in FIG. 1) allowing the tray 14 to be slightly elevated from the base 16. The handle portion 40 of the tray is exposed permitting easy removal of the tray 14. The lid 12 is in the open position but may be pivoted to a closed position enclosing the tray 14 between the lid 12 and the base 16.

In order to store the storage case 10 in a mechanic's toolbox with relatively shallow drawers, the lid 12 may be removed in a manner as described above and discarded or stored according to the desires of the user. Because a typical toolbox drawer can be approximately 2 inches in height, the tray 14 and the base 16 preferably have a thickness of about 2 inches or less when the tray 14 is seated in the base 16. In a preferred embodiment, the tray 14 and base 16 combined have a thickness of about 1¾ inch. The tray 14 itself in a preferred embodiment has a thickness of about ½ inch. The base 16 has a thickness of about 1½ inch. In cases where the toolbox drawer is too shallow to accommodate both the tray 14 and the base 16, the tray 14 may be removed and placed in the drawer and the base 16 may be placed in another drawer. Similarly, the lid 12 can be stored in another drawer.

It may be desirable to remove the lid 12 from the base 16 and nest the tray 14 right side up in the upside down lid 12. To achieve this result, in some embodiments of the invention, the lid 12 and the tray 14 are dimensioned so that the tray 14 will nest in the lid 12. When the tray 14 and the lid 12 are nested, the top surface 58 of the tray 14, fits flush with a top surface 60 of the inverted lid 12. When the lid 12 and tray 14 are nested in this manner, the bottom 62 of the tray 14 will sit against the floor 64 of the lid 12.

Preferably the case 10 is made of plastic. The case 10 can be blow molded, injection molded or made according to other means well known in the art.

Although an example of the storage case 10 is shown containing a fuel injection servicing kit, it will be appreciated that other items can be stored in the storing case 10. One skilled in the art will be able to adapt the present invention to store any number of items. Thus, the description of the present invention being used to store a fuel injection service kit is exemplary and not limiting.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A storage unit comprising:

a base having at least one seating surface and a top peripheral edge located above the seating surface;

a tray having two opposed ends configured to sit within the base on the seating surface and be removable from the base, the tray having a plurality of cavities to provide storage areas for items, the tray and the base configured to be no greater than about 2 inches in height and to define a storage area between the tray and the base when the tray is seated in the base the tray projecting above the base when resting on the seating surface and the tray also having disposed on each end thereof a ridge forming a respective indented handle portion, which at least partially extends above the top edge of the base when the tray is resting on the seating surface; and a lid configured to be pivotally attached to the base and removable from the base, the lid configured to enclose the tray between the base and the lid when the lid is in a closed position.

2. The storage unit of claim 1, wherein the tray has a hole extending through the tray and configured to hold a part in a way to permit at least a portion of the part to extend outside a plane defined by surfaces associated with the tray.

3. The storage unit of claim 1, further comprising a door pivotally attached to the tray configured to pivot between an open and closed position and snap in place when in the closed position.

4. The storage unit of claim 3, wherein the door is transparent.

5. The storage unit of claim 3, wherein the door defines in part a storage area, and a removable container is stored in the storage area.

6. The storage unit of claim 1, further comprising a list mounted in the lid listing the items the storage unit is configured to contain.

7. The storage unit of claim 1, wherein the cavities are each configured to store a part in at least one of loosely, in a press fit manner, and a snap fit manner.

8. The storage unit of claim 1, wherein the base is about 1 and ½ inch thick.

9. The storage unit of claim 1, further comprising a handle mounted on the lid.

10. The storage unit of claim 1, further comprising at least one closing buckle mounted on the lid and configured to latch to the base.

11. The storage unit of claim 1, wherein the tray and the base when nested are configured to be no greater than about 1¾ inches in height.

12. The storage unit of claim 1, wherein the tray fits in the lid when the lid is inverted and the tray is facing upright and the tray is substantially flush with the lid.

13. A storage unit comprising:

a base having at least one seating surface and a top peripheral edge located above the seating surface;

means for containing having two opposed ends configured to sit within the base on the seating surface and be removable from the base, the containing means having a plurality of cavities to provide storage areas for parts, the containing means and the base configured to be no greater than about 2 inches in height and to define a storage area between the containing means and the base when the containing means is seated in the base the containing means projecting above the base when resting above the seating surface and the tray also having disposed on each end thereof a ridge forming a respective indented handle portion, which at least partially extends above the top edge of the base when the tray is resting on the seating surface; and means for covering the containing means, configured to be pivotally attached to the base and removable from the base, and lid configured to enclose the containing means between the base and the covering means when the covering means is in a closed position.

14. The storage unit of claim 13, wherein the containing means has a hole extending through the containing means and configured to hold a part in a way to permit at least a portion of the part to extend outside a plane defined by surfaces associated with the containing means.

15. The storage unit of claim 13, further comprising an enclosing means attached to the containing means configured to move between an open and closed position and snap in place when in the closed position.

16. The storage unit of claim 13, further comprising a means for carrying mounted on the covering means.

17. The storage unit of claim 13, wherein the containing means includes at least one handle.

18. The storage unit of claim 13, further comprising a means for latching mounted on the covering means and configured to latch to the base.

19. The storage unit of claim 13, wherein the containing means and base are configured to be no greater than about 1 and ¾ inches in height.

20. The storage unit of claim 13, wherein the containing means fits in the covering means when the covering means is inverted and the containing means is facing upright and is substantially flush with the covering means.

* * * * *